US006332634B1

(12) United States Patent
Fukumoto et al.

(10) Patent No.: US 6,332,634 B1
(45) Date of Patent: Dec. 25, 2001

(54) REMOTE CONTROL DEVICE FOR VEHICULAR SLIDE DOOR APPARATUS

(75) Inventors: Ryoichi Fukumoto, Nagoya; Katsuhisa Yamada, Toyota; Masao Ohhashi, Kariya; Shintaro Suzuki, Kasugai, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/469,231

(22) Filed: Dec. 22, 1999

(30) Foreign Application Priority Data

Dec. 22, 1998 (JP) ..... 10-365332

(51) Int. Cl.[7] ..... E05C 3/06

(52) U.S. Cl. ..... 292/201; 292/DIG. 23; 292/216

(58) Field of Search ..... 292/216, 201, 292/DIG. 23; 49/279, 280

(56) References Cited

U.S. PATENT DOCUMENTS 5,277,461 * 1/1994 Dzurko ..... 292/216
5,975,596 * 11/1999 Rogers ..... 292/216
6,135,513 * 10/2000 Hamada ..... 292/201

FOREIGN PATENT DOCUMENTS 10-317756 12/1998 (JP) .

* cited by examiner

*Primary Examiner*—Gary Estremsky
(74) *Attorney, Agent, or Firm*—Burns, Doane, Swecker & Mathis, LLP

(57) ABSTRACT

A remote control device for a vehicular slide door apparatus includes a shaft 13, an input lever 14 fixedly mounted on the shaft 13 so as to be rotated together therewith, an opening-directional lever 18 rotatable mounted on the shaft 13 and rotated by the input lever 14 when the shaft 13 is rotated in one direction, a closing-directional lever 19 rotatable mounted on the shaft 13 and rotated by the input lever 14 when the shaft 13 is rotated in the other direction, an open lever 15 rotatable mounted on the shaft 13 and associated with the closing-directional lever 19, and an output lever 16 rotatably mounted on the shaft 13 and associated with the open lever 15. In accordance with the present invention, the opening-directional lever 8, the closing-directional lever 19, the open lever 15, and the output lever 16 are mounted on the common shaft 13, which is unlike the conventional structure wherein two shafts are required to support these lever elements. Thus, the present invention can offer a more simplified structure of the remote control device for vehicular slide door apparatus.

5 Claims, 7 Drawing Sheets

REMOTE CONTROL DEVICE FOR VEHICULAR SLIDE DOOR APPARATUS

This application is based on and claims priority under 35 U.S.C. §119 with respect to Japanese Application No. 10(1998)-365332 filed on Dec. 22, 1998, the entire content of which is incorporated herein by reference.

BACKGROUND OF THE INVENTION

1. Field of the Invention

The present invention relates to a remote control device which operates simultaneously a pair of door look devices of a vehicular slide door apparatus.

2. Prior Art

A conventional remote control device of the type is disclosed, for example, in Japanese Patent Laid-open. Print No. Hei. 10-317756, published in 1998 without examination. The remote control device operates a pair of door lock devices simultaneously when an operating member is manipulated such as an inside handle, an outside handle, an indoor lock knob, or an outdoor key cylinder. The conventional remote control device includes a shaft, an input shaft fixedly mounted on the shaft so as to be rotated together therewith, an opening-directional lever rotatably mounted on the shaft and being rotated by the input lever when the shaft is rotated in one direction, a closing-directional lever rotatably mounted on the shaft and is rotated by the input lever when the shaft is rotated in the other direction, a secondary shaft, an open lever rotatably mounted on the secondary shaft and associated with the closing-directional lever, and an output lever rotatably mounted on the secondary shaft and associated with the open lever.

In the foregoing structure, the inside handle is coupled to the shaft, the open lever is coupled to the outside handle, and the open lever is coupled to the door lock devices in pair.

However, the open lever and the output lever are rotatably mounted on the secondary shaft which is independent of the shaft, which means that the remote control device is of two-shaft configuration, thereby enlarging the bulk thereof.

Accordingly, a need exists for a control device for vehicular slide door apparatus without the foregoing drawback.

SUMMARY OF THE INVENTION

The present invention has been developed to satisfy the need noted above and thus has a primary object of the provision of a remote control device for vehicular slide door apparatus which comprises:

- a rotatable shaft;
- an input lever fixedly mounted on the shaft so as to be rotated together therewith;
- an opening-directional lever rotatably mounted on the shaft and positioned to be rotated by the input lever when the shaft is rotated in a first direction;
- a closing-directional lever rotatably mounted on the shaft and positioned to be rotated by the input lever when the shaft is rotated in a second direction opposite the first direction;
- an open lever rotatably mounted on the shaft and selectively engagable with the closing-directional lever; and
- an output lever rotatable mounted on the shaft and connected to the open lever.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Preferred embodiment of the present invention will be described hereinafter in detail with reference to the accompanying drawings.

Figure 1:
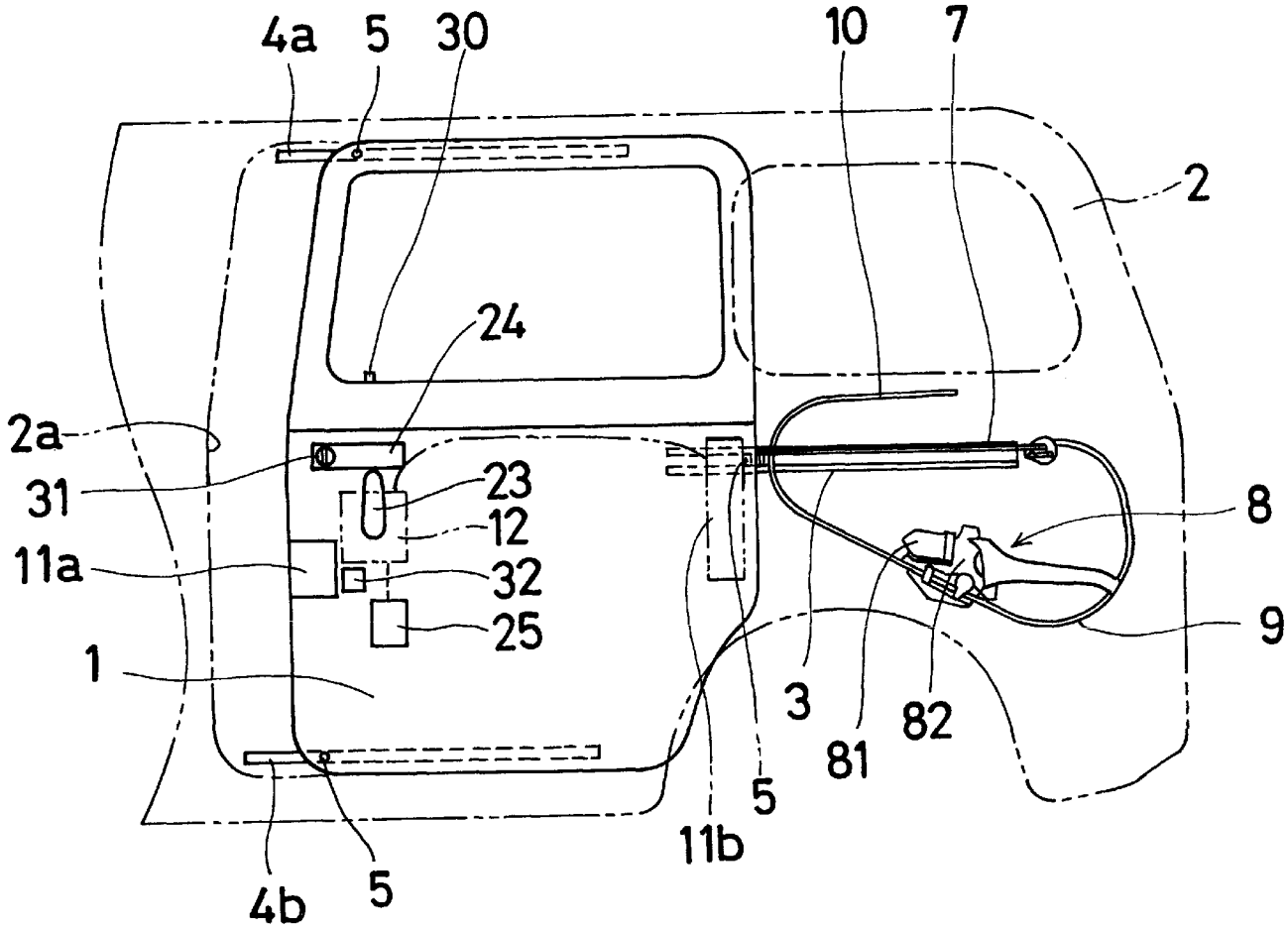
FIG. 1 is a side view of a vehicle body to which is applied a slide door apparatus according to the present invention.
Figure 2:
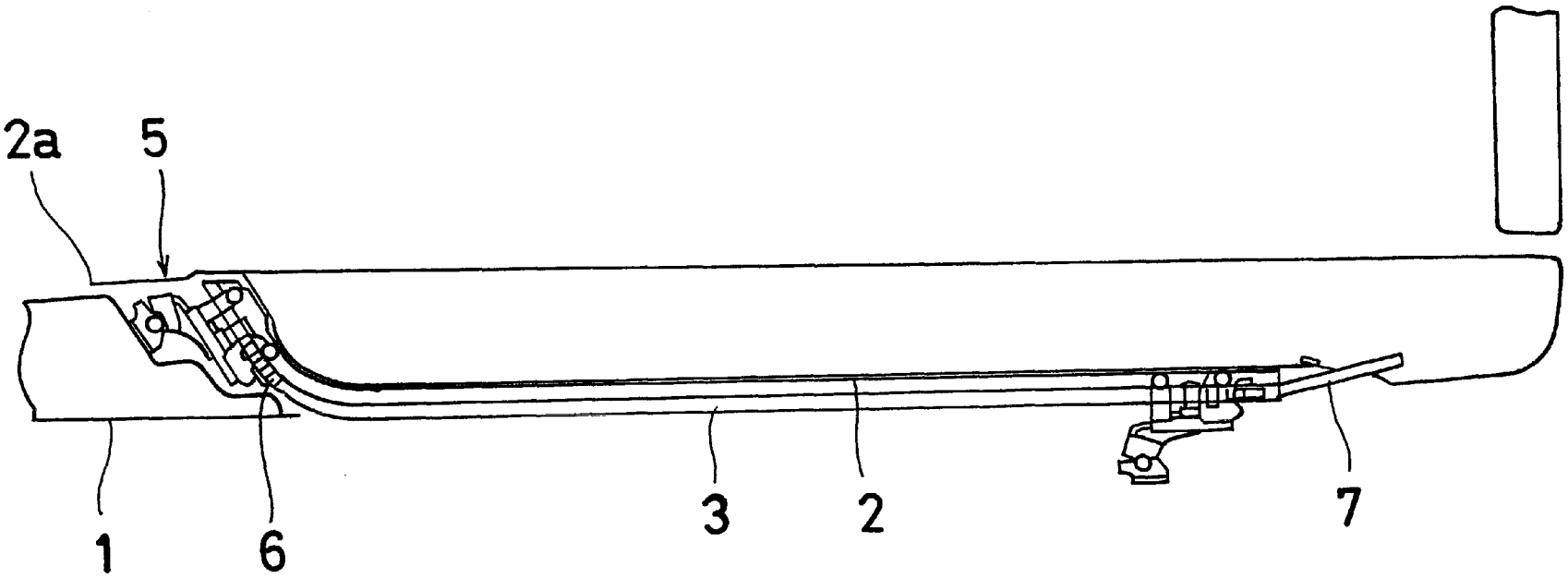
FIG. 2 is a horizontal cross-sectional view of the front view of the slide door apparatus shown in FIG. 1.

First of all, with reference to FIGS. 1 and 2, there is illustrated a rear portion of a vehicle body of a van type vehicle. The vehicle body is formed at its lateral side body 2 with an opening area 2*a* which is configured into a substantially rectangular shape. The opening area 2*a* is closed and opened by a slide door 1 which is supported by an upper guide rail 4*a,* a lower guide rail 4*b,* and a center guide rail 3 so as to be movable in the vehicle lengthwise direction which corresponds to right-and-left direction in FIG. 1.

The upper guide rail 4*a* is arranged along an upper periphery of the opening area 2*a* so as to be close thereto and is secured to the lateral side of the vehicle body 2 by means of suitable connecting devices such as screws (not shown), while the lower guide rail 4*b* is arranged along a lower periphery of the opening area 2*a* so as to be closed thereto and is secured to the lateral side body 2 of the vehicle body by means of suitable connecting devices such as screws (not shown). The center guide rail 3 is positioned at a rear side of the opening area 2*a* and is secured to secured to the lateral side body 2 of the vehicle body by means of suitable connecting devices such as screws (not shown).

The slide door 1 is provided with three guide roller units 5 which are in sliding engagement with the guide rails 3, 4*a,* and 4*b,* respectively, thereby allowing the slide door 1 to slide along the guide rails 3, 4*a,* and 4*b*. It is to be noted that the guide rails 3, 4*a,* and 4*b* are in parallel to each other and extend in the vehicle lengthwise direction. For establishing coplanar relationship between an outer surface of the slide door and an outer surface of the lateral side 2 of the vehicle body when the opening area 2*a* is in fully closed condition by the slide door 1, a front end of each of the guide rails 3, 4*a,* and 4*b* is bent toward an inner space of the vehicle body 2. When the opening area 2*a* is in fully opened condition, the slide door 1 is positioned at the rear side of the opening area 2*a* and is in an overlapped or layered condition relative to the lateral side body 2 of the vehicle body 2.

The roller unit 5 which slides along the center guide rail 3 is connected to one end of a geared cable 6 which passes through guide pipes 7, 9, and 10. The other end of the geared cable 6 is in the form of a free end configuration. Between the guide pipes 7 and 9, the geared cable 6 is connected to a drive device 8 which is accommodated in the lateral side body 2. The drive device 8 includes an electric motor 81 and a clutch mechanism 83 (FIG. 6) so as to establish and interrupt a connection between the geared cable 6 and the motor 81, which allows an electric sliding mode and a manual sliding mode of the slide door 1 when the clutch mechanism 83 is in an ON condition and an OFF condition, respectively.

The guide pipe 7 extends long the center guide rail 3 and is secured thereto. The guide pipe 9 is fixed to inside the vehicle body 2 and one end of the guide pipe 9 passes therethrough for being connected to the guide pipe 7 at the rear portion of the guide rail 3. The other end of the guide pipe 9 is connected to a case 82 of the drive device 8. The guide pipe 10 is fixed inside the vehicle body 2 and is connected to the drive device 8.

In the foregoing structure, when the drive device 8 is turned on, the geared cable 6 is moved in one direction (the other direction), which causes a movement of the center positioned roller unit 5 along the center guide rail 3, with the result that the slide door 1 is moved along the guide rails 3, 4*a,* and 4*b,* thereby opening (closing) the opening area 2*a.*

A pair of door lock device 11*a* and 11*b,* each of which has a closer 11*c* (FIG. 6), are accommodated in the slide door 1 so as to be positioned at a front end and a rear end thereof, respectively. The door lock devices 11*a* and 11*b* maintain the slide door 1 in a position fully closing the opening area 2*a* by being engaged with a pair of strikers (not shown) which are secured to a front periphery and a rear periphery of the opening area 2*a,* respectively The closer 11*c* is used to pull the slide door 1 toward the opening area 2*a* for establishing a perfect closed condition of the slide door 1. In addition, in the slide door 1 there is provided a remote control device 12 which simultaneously operates the door lock devices 11*a* and 11*b*.

Figure 3:
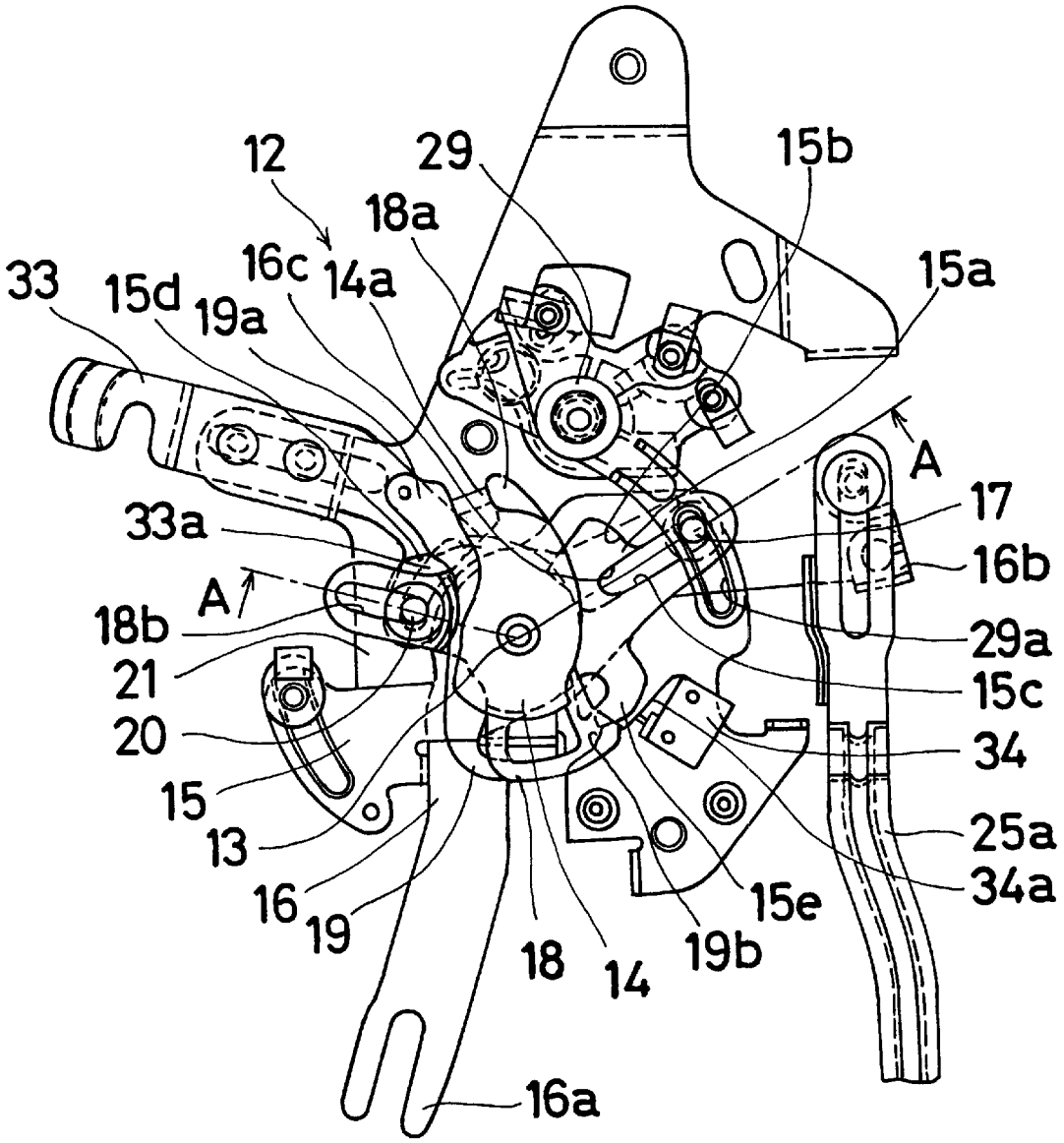
FIG. 3 is a front view of a remote control device associated with the slide door apparatus shown in FIG. 1.
Figure 4:
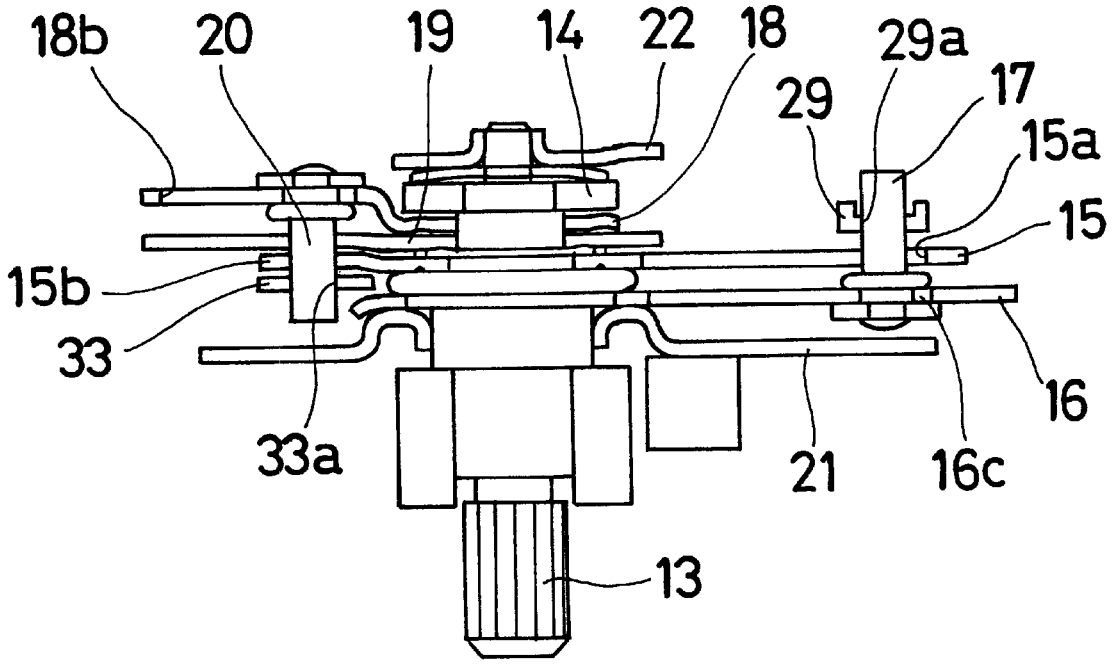
FIG. 4 is a cross-sectional view taken along line A—A in FIG. 3.
Figure 5:
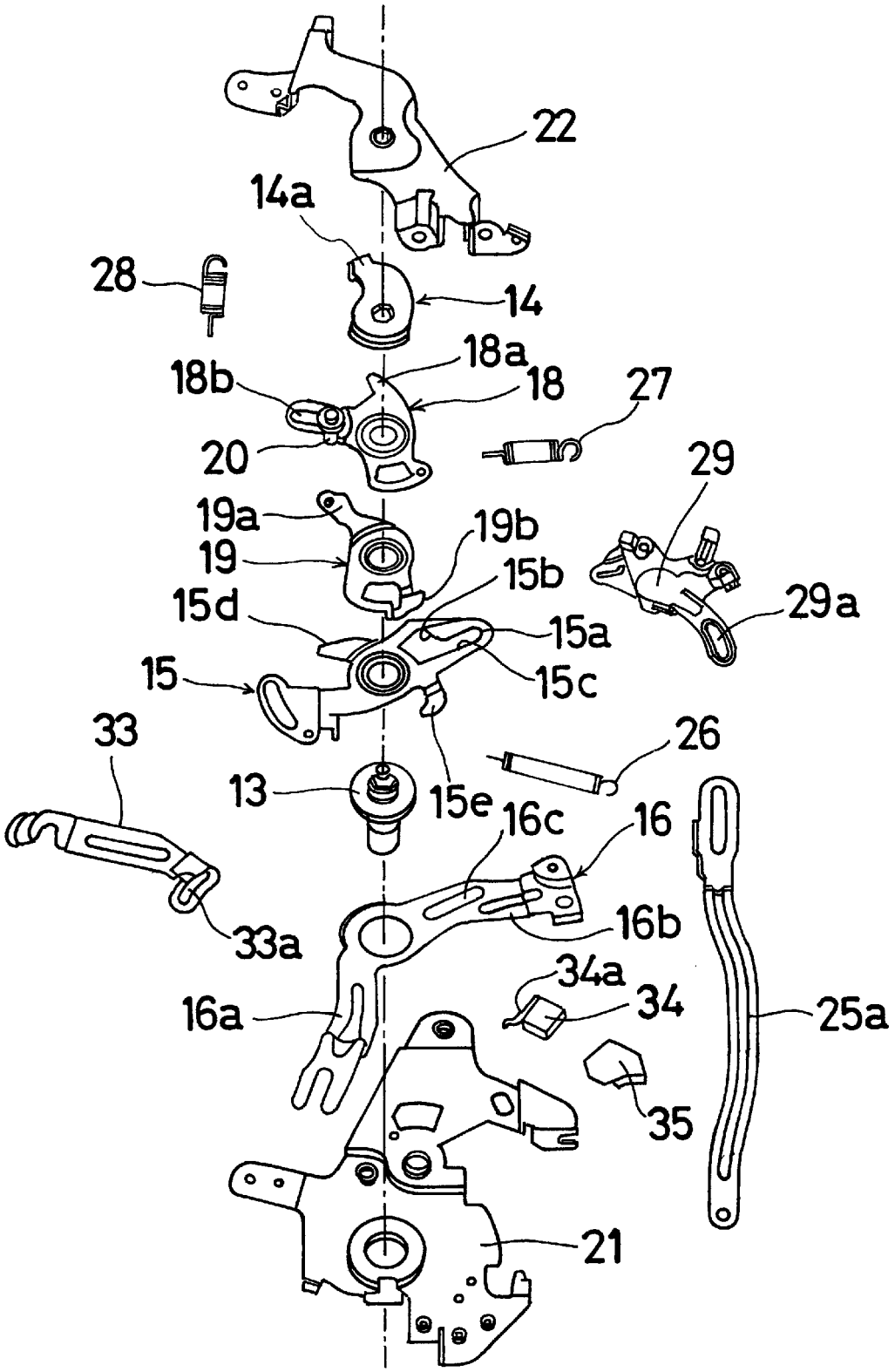
FIG. 5 is an exploded perspective view of the remote control device shown in FIG. 3.

As shown in FIGS. 3 to 5 inclusive, the remote control device 12 includes, as its major elements, a shaft 13, an input lever 14, an open lever 15, and an output lever 16.

The shaft 13 is journaled in a pair of base plates 21 and 22 which are secured to the slide door 1 by bolts (not shown). The input lever 14, the open lever 15, and the output lever 16 are mounted on the shaft 13 between the base plates 21 and 22. The shaft 13 extends into an interior space of the vehicle 2 through the slide door 1 and is connected to an inside handle 23 so as to be rotated together therewith (FIG. 1). The input lever 14 is fixed to the shaft 13 so as to be rotated together therewith.

The open lever 15 is rotatable on the shaft 13 and is connected to an outside handle 24 (FIG. 1) positioned outside the slide door 1 by way of a rod (not shown). In addition, as best shown in FIG. 5, the open lever 15 is formed near its outer periphery with an arc-shaped slot 15*b* whose axis is common to the shaft 13. The open lever 15 is also formed with an irregular-shaped slot 15*a* including a straight slot 15*c* which extends in the radial direction of the shaft 13.

The output lever 16 is rotatably mounted on the shaft 13. One arm 16*a* of the output lever 16 is coupled to the frontward positioned door lock 11*a,* while the other arm 16*b* is coupled to the rear positioned door lock 11*b* by way of a cable (not shown). In addition, the output lever 16 is formed therein with a longitudinal slot 16*c* extending in the radial direction of the shaft 13 and overlapping with the irregular-shaped slot 15*a* of the open lever 15.

A slide pin 17 is positioned in sliding engagement with the irregular-shaped slot 15*a* of the open lever 15 and the slot 16*c* of the output lever 16. The slide pin 17 is, as can be seen from FIG. 4, provided on the output lever 16 so as not to be extracted therefrom. The slide pin 17 is used to rotate the output lever 16 by transmitting a rotational torque thereto when the slide pin 17 is positioned in the engaging portion 15*c* of the irregular-shaped slot 15*a* after sliding along the slot 16*c,* while if the slide pin 17 is positioned in the slot 15*b* of the irregular-shaped slot 15*a,* the open lever 15 is made to null relative to, or is effectively decoupled from, the output lever 16. Thus, the slide pin 17 engages and disengages the open lever 15 with the output lever 16 in selective fashion. It is to be noted that a spring 26 is interposed between the open lever 15 and the base plate 21, by which the open lever 15 is biased continually in the clockwise direction.

On the shaft 13, there are rotatably mounted an opening-directional lever 18 and a closing-directional lever 19. The input lever 14 is provided with an integral bent flange 14*a* which extends in parallel to the shaft 13. The opening-directional lever 18 and the closing-directional lever 19 are formed with opposed projections 18*a* and 19*a* between which the flange 14*a* of the input lever 14 is positioned. Thus, if the input lever 14 is rotated in one direction (the clockwise direction in FIG. 3), engagement of the flange 14*a* of the input lever 14 with the projection 18*a* causes rotation of the opening-directional lever 18, while if the input lever 14 is rotated in the other direction (the counter-clockwise direction in FIG. 3), engagement of the flange 14*a* of the input lever 14 with the projection 19*a* causes rotation of the closing-directional lever 19. It is to be noted that a spring 27 is interposed between the open-directional lever 18 and the base plate 22, thereby urging continually the opening-directional lever 18 in a direction to engage its projection 18*a* with the flange 14*a* (in the counter-clockwise direction in FIG. 3), while a spring 28 is interposed between the closing-directional lever 19 and the base plate 22, thereby urging continually the closing-directional lever 19 in a direction to engage its projection 19*a* with the flange 14*a* (in the clockwise direction in FIG. 3).

The opening-directional lever 18 is provided therein with a linear slot 18*b* which extends in the radial direction of the shaft 13. The open lever 15 is provided with a projection 15*d* which overlaps with the slot 18*b* in such a manner that the projection 15*d* and the slot 18*b* make a right angle. A slide pin 20 is in sliding engagement with the slot 18*b* and is mounted on the lever 18 so as not to be extracted therefrom. The slide pin 20 is slidable in the slot 18*b,* rotates the open lever 15 by transmitting a rotational torque thereto from the opening-directional lever 18 when the slide pin 20 is in engagement with the projection 15*d,* and when the slide pin 20 is out of engagement with the projection 15*d* makes the opening-directional lever 18 null relative to, or effectively disengaged from, the open lever 15. Thus, the slide pin 20 selectively engages and disengages the opening-directional lever 18 with the open lever 15.

A locking lever 29 is rotatably mounted on the slide pin 17. The locking lever 29 is connected via rods (not shown) to an indoor lock knob 30 in the interior of the vehicle body 2, an outdoor key cylinder 31 positioned outside the slide door 1, and a locking actuator 32 accommodated in the slide door 1, respectively, as shown in FIG. 1. The locking actuator 32 includes an electric motor (not shown) as its driving source to rotate the locking lever 29. The locking lever 29 is formed therein with an arc-shape slot 29*a* whose center axis is in coincidence with an axis of the shaft 13. The arc-shaped slot 29*a* overlaps with the slot 15*a* of the open lever 15 and the slot 16*a* of the output lever 16. The slide pin 17 is fitted in the arc-shaped slot 29*a* so as to be slid therealong when the locking lever 29 is rotated. It is to be noted that the center axis of the arc-shape slot 29*a* is in coincidence with an axis of the shaft 13 when the slide pin 17 is in the engaging portion 15*c* of the irregular-shaped slot 15*a*. Thus, when the open lever 15 is rotated together with the output lever 16 by way of the slide pin 17, the resulting rotating slide pin 17 becomes free from its interference with the locking lever 29, thereby ensuring smooth rotations of the open lever 15 and the output lever 16.

Between the base plates 21 and 22, there is provided a child-proof lever 33 so as to be movable in the horizontal direction in FIG. 4. The child-proof lever 33 has an arc-shaped slot 33*a* whose center axis is common to that of the shaft 13. The arc-shaped slot 33*a* overlaps with the slot 18*b* of the opening-directional lever 18. The slide pin 20 passes through the arc-shaped slot 33*a*, which moves slide pin 20 along the slot 18*b* when the childproof lever 33 is moved. It is to be noted that the center axis of arc-shape slot 33*a* is in coincidence with the axis of the shaft 13 when the slide pin 20 is in engagement with the projection 15*d* of the open lever 15. Thus, when the open-directional lever 18 is rotated together with the open lever 15 by way of the slide pin 20, the resulting rotating slide pin 20 becomes free from its interference with the childproof lever 33, thereby ensuring smooth rotations of the open lever 15 and the output lever 16.

The closing-directional lever 19 has a cam profile 19*b*. The open lever 15 has a cam arm 15*e*. A handle switch 34 is fixedly mounted on the base plate 21 so as to oppose the cam profile 19*b* and the cam arm 15*e*. The handle switch 34 has a lever 34*a* which is in engagement with both the cam profile 19*b* and the cam arm 15*e* and is closed when the lever 34*a* is urged by either of the cam surface 19*b*, when the closing-directional lever 19 is rotated, and the cam arm 15*e*, when the open lever 15 is rotated. The handle switch 34 is covered with a water proof cover 35 which is also fixedly mounted on the base plate 21.

The remote control device 12 having the foregoing structure operates as follows:

In FIG. 3, the slide pin 17 is located at the engaging portion 15*c* of the irregular-shaped slot 15*a* of the open lever 15, while the slide pin 20 is in engagement with the projection 15*d* of the open lever 15. Thus, the remote control device 12 is in its unlocked condition.

When a passenger (not shown) inside the vehicle body 2 manipulates the inside handle 23 to open the slide door 1 in a manual mode, the shaft 13 which rotates together with the inside handle 23 and the input lever 14 which rotates together with the shaft 13 are rotated in the clockwise direction in FIG. 3, which causes the flange 14*a* of the input lever 14 to engage with the projection 18*a* of the open-directional lever 18, thereby rotating the opening-directional lever 18 in the clockwise direction in FIG. 3 against the urging force of the spring 27. The resultant rotation of the opening-directional lever 18 is transmitted by way of the slide pin 20 to the open lever 15, which causes a rotation of the open lever 15 in the clockwise direction in FIG. 3 against the urging force of the spring 26. The resultant rotation of the open lever 15 is transmitted by way of the slide pin 17 to the output lever 16, which causes a rotation of the output lever 16 in the clockwise direction in FIG. 3. Thus, the door lock devices 11*a* and 11*b* are operated, which allows manual mode operation of the slide door 1.

On the other hand, when a passenger (not shown) inside the vehicle body 2 manipulates the inside handle 23 to close the slide door 1 in a manual mode, the shaft 13 which rotates together with the inside handle 23 and the input lever 14 which rotates together with the shaft 13 are rotated in the counter-clockwise direction in FIG. 3, which causes the flange 14*a* of the input lever 14 to engage with the projection 19*a* of the closing-directional lever 19, thereby rotating the closing-directional lever 19 in the counter-clockwise direction in FIG. 3 against the urging force of the spring 28. The resultant rotation of the closing-directional lever 19 is not transmitted to the output lever 16 due to the fact the closing-directional lever 19 is out of engagement with the output lever 16, which therefore does not operate the door lock devices 11*a* and 11*b*. This means that a slight force is required to manipulate the slide door 1. It is to be noted that upon a closing movement of the slide door 1, the door lock devices 11*a* and 11*b* are operated in a compulsory fashion to maintain the slide door 1 at its closed condition, whereby the remote control device 12 is not requested to operate the door lock devices 11*a* and 11*b*. At this time, the lever 34*a* of the handle switch 34 is urged to establish the closure thereof. The closure of the handle switch 34 will be detailed later.

When the passenger outside the vehicle body 2 manipulates the outside handle 24 for opening the slide door 1 in a manual mode, the open lever 15 is rotated in the counter-clockwise direction in FIG. 3 against the urging force of the spring 26. The resultant rotation of the open lever 15 is transmitted by way of the slide pin 17 to the output lever 16, thereby rotating the output lever 16 in the counter-clockwise direction in FIG. 3, with the result that the door lock devices 11*a* and 11*b* are operated, which allows the slide door 1 to move in manual mode. At this time, the cam arm 15*e* of the open lever 15 is urged against the lever 34*a* of the handle switch 34, thereby closing the handle switch 34. The closure of the handle switch 34 will be detailed later.

When the passenger outside the vehicle body 2 manipulates the outside handle 24 for closing the slide door 1 in a manual mode, the open lever 15 is rotated in the counter-clockwise direction in FIG. 3 against the urging force of the spring 26. The resultant rotation of the open lever 15 is transmitted by way of the slide pin 17 to the output lever 16, thereby rotating the output lever 16 in the counter-clockwise direction in FIG. 3, with the result that the cam arm 15*e* of the open lever 15 is urged against the lever 34*a* of the handle switch 34, thereby closing the handle switch 34. The closure of the handle switch 34 will be detailed later. At this time, the door lock devices 11*a* and 11*b* operates without troubles due to initiation of the closer 11*c* when the opening area 2*a* is fully closed.

Upon one of manipulation of the indoor locking knob 30, manipulation of the outdoor key cylinder 31, and driving of the locking actuator 32, the locking lever 29 is rotated in the clockwise direction in FIG. 3 and is moved from the engaging portion 15*c* of the irregular-shaped slot 15*a* to the null portion 15*b* thereof, with the result that a null operation of the open lever 15 is made relative to the output lever 16. Under the resultant condition, even if the inside handle 23 or the outside handle 24 is manipulated, the rotational torque of the open lever 15 can not be transmitted to the output lever 16, thereby operating neither of the door lock devices 11*a* and 11*b*. The reason is that the door lock devices 11*a* and 11*b* are operated subject to the clockwise direction of the output lever 16 in FIG. 3. Thus, the remote control device 12 is in locked condition.

Moving the childproof lever 33 in the rightward direction in FIG. 3 causes a sliding movement of the slide pin 20 along the slot 18*b* in the opening-directional lever 18 so as to be removed from the projection 15*d* of the open lever 15. Thus, the movement of the opening-directional lever 18 becomes null relative to, or effectively decoupled from, the open lever 15. Under the resultant condition, despite manipulation of the inside handle 23, the rotation of the opening-directional lever 18 can not be transmitted to open lever 15. Thus, without clockwise rotation of the open lever 15 in FIG. 3, the door lock devices 11*a* and 11*b*fail to operate. Thus, the remote control device 12 is in a child-lock condition. It is to be noted that when the remote control device 12 is in an unlocked condition as well as a child-lock condition, manipulating the inside handle 24 fails to operate the door lock devices 11*a* and 11*b*. In addition, even if the remote control device 12 is in child-lock condition, manipulating the outside handle 24 rotates the open lever 15, thereby operating the door lock devices 11*a* and 11*b* when the remote control device 12 is also in an unlocked condition.

Figure 6:
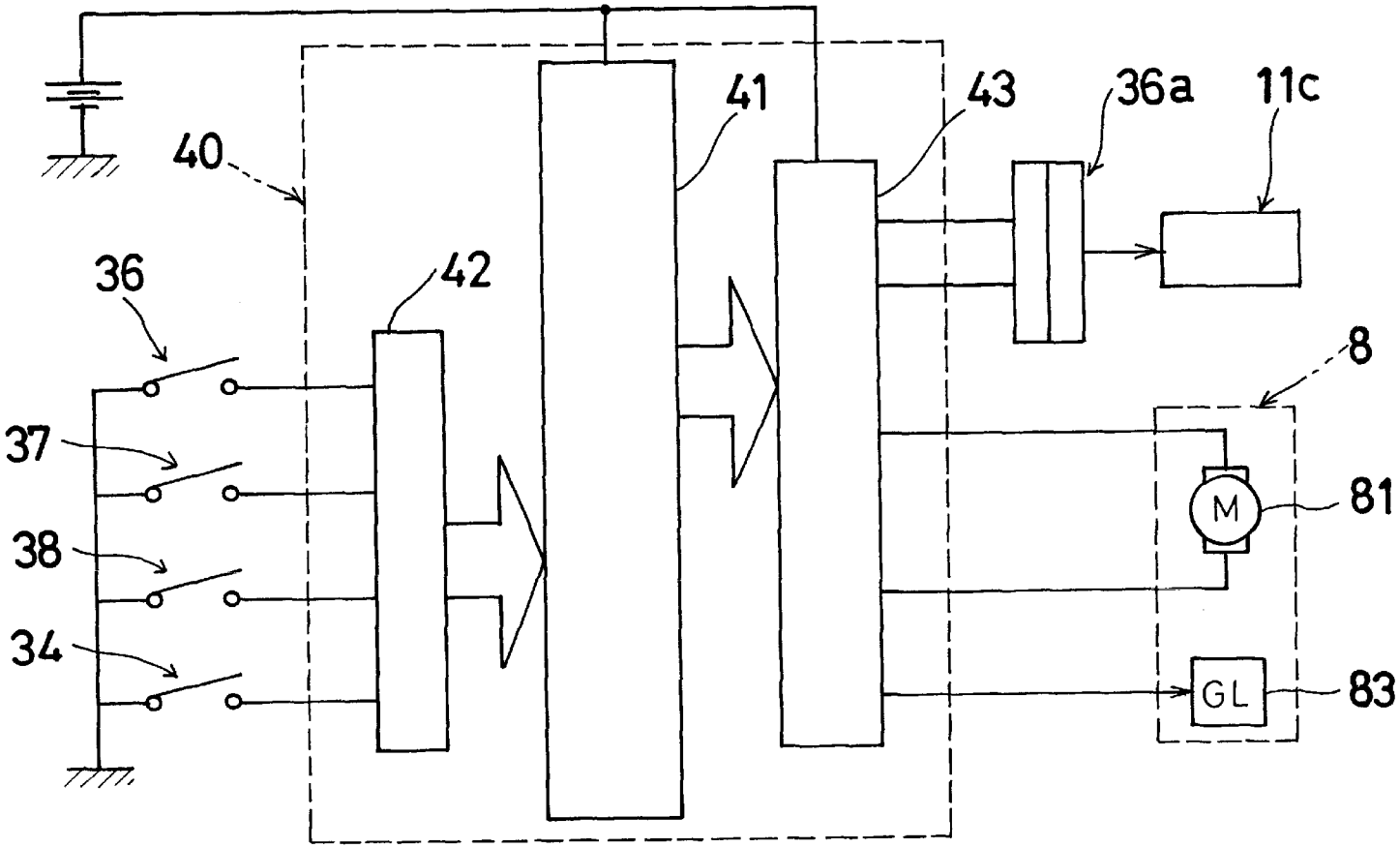
FIG. 6 is an electric circuit diagram for the remote control device shown in FIG. 3.

With reference to FIG. 6, a door control device 40 includes a controller 41 which is in the form of a microprocessor, an input interface 42, and a drive circuit 43. The input interface 42 is connected electrically with the handle switch 34, a junction switch 36 with a power feeding portion 36*a*, a courtesy switch 37, and a pawl switch 38. The drive circuit 43 is connected with the closer 11*c* by way of the power feeding portion 36*a* of the junction switch 36, the electric motor 81 and a clutch mechanism 83 of the drive device 8.

The junction switch 36 is positioned between the slide door 1 and the vehicle body 2, becomes ON condition whenever the slide door 1 closes the opening area 2*a*, and becomes OFF condition whenever the slide door 1 begins to open the opening area 2*a*. The junction switch 36 when in an ON condition establishes an electric power supply by way of the power feeding portion 36*a* from the side of the vehicle body 2 to the side of the slide door 1. The courtesy switch 37, which is provided to the vehicle body 2, is opened and closed when engaged with the slide door 1 when in a fully closed condition and when the slide door 1 is in opened condition or imperfectly closed, respectively. The pawl switch 38, which is attached to each of the door lock devices 11*a* and 11*b*, is set to be closed when the slide door 1 is in a fully or imperfectly closed condition. The closer 11*c* is driven when its own driving source or electric motor is turned on, which causes pulling the slide door 1 toward the opening area 2*a* for establishing fully closed condition of the opening area 2*a*. Terminating the driving source causes the closer 11*c* to stop. When the clutch mechanism 83 of the drive device 8 is engaged and disengaged, the electric motor 81 is coupled to and isolated from the geared cable 6, respectively. When the motor 81 is driven in one direction and the other direction, the slide door 1 is moved in electric mode to open and close the opening area 2*a*, respectively. The slide door 1 is stopped when the motor 81 is turned off.

Figure 7:
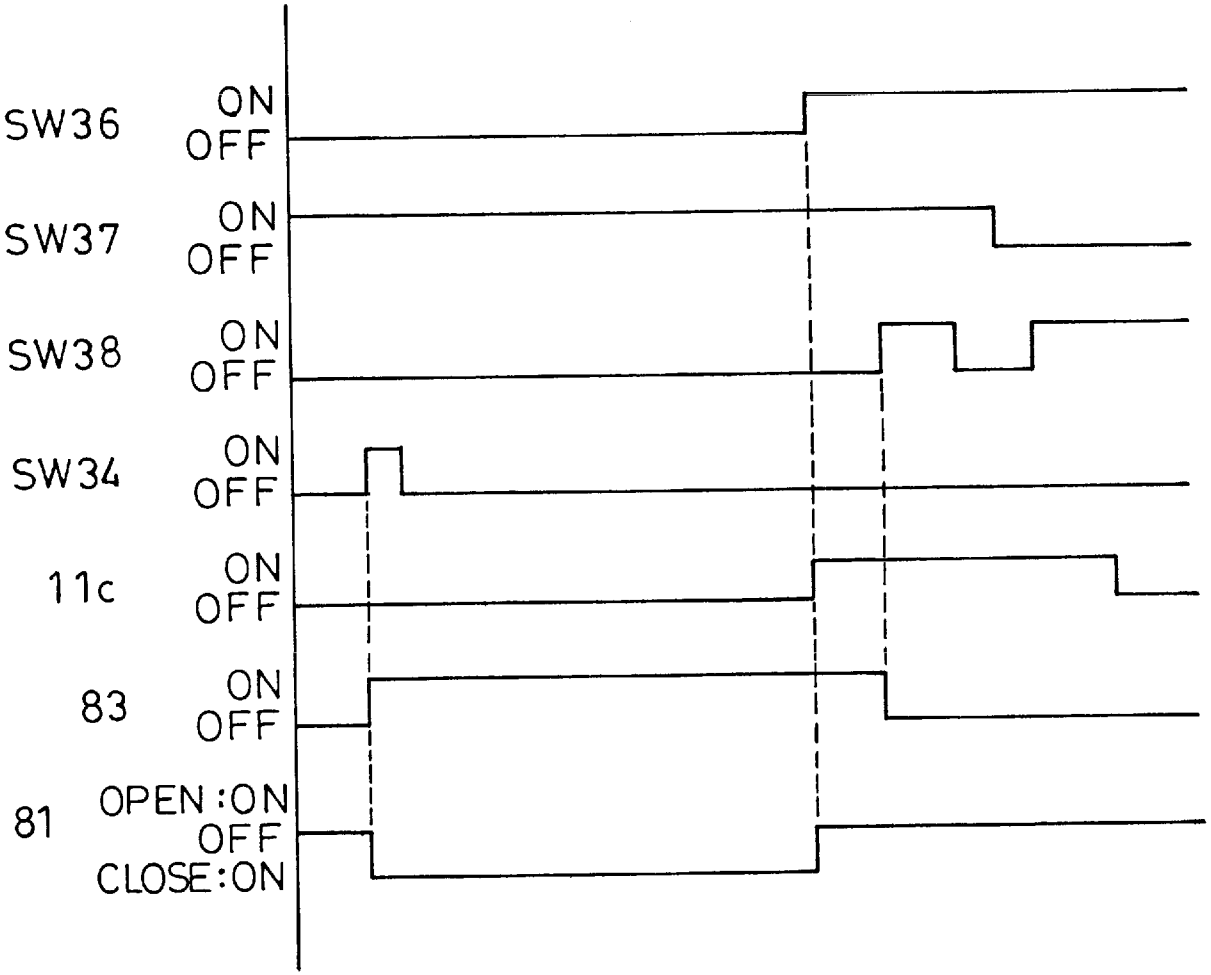
FIG. 7 is a timing chart showing an operation of the remote control device shown in FIG. 3.

Operation of the door control device 40 will be described hereinafter with reference to a timing chart illustrated in FIG. 7.

As previously explained, when the passenger inside the vehicle body 2 manipulates the inside handle 23 to close the slide door 1 in a manual mode, the handle switch 34 is turned on. On the basis of the resultant electric signal or closed condition of the handle switch 34, the clutch mechanism 83 is engaged or becomes ON, which causes coupling between the electric motor 81 and the geared cable 6 and the motor 81 is driven in the other direction, which causes the slide door 1 to close. Thus, the slide door 1 is moved in an electric mode, which assists manual closing movement of the slide door 1.

When the slide door 1 reaches a position just before its fully closed condition, the junction switch 36 is turned on, which stops the electric motor 81, thereby terminating the sliding movement of the slide door 1. Simultaneously, the closer 11*c* is driven, and the slide door 1 begins to be pulled toward the opening area 2*a* to establish its fully closed condition.

If the slide door 1 is in an imperfectly closed or half-latched condition during such a pulling operation, the pawl switch 38 is closed, which causes the clutch mechanism 83 to disengage, and the coupling between the electric motor and the geared cable 6 is interrupted. In addition, upon establishment of a fully closed condition of the slide door 1, the pawl switch 38 is closed again, which after a predetermined time duration causes the closer 11*c* to terminate.

As explained above, when the passenger inside the vehicle body 2 manipulates the inside handle 23 to close the slide door 1 in manual mode, immediately the slide door 1 is placed in electric mode, which assists the manual operation of the slide door 1 to close from the inside of the vehicle body 2, thereby realizing closure of the slide door 1 from the inside of the vehicle body 2 without any effort.

The same operation is made when the slide door 1 is moved to close from outside the vehicle body 1.

When the passenger inside the vehicle body 2 manipulates the inside handle 23 to open the slide door 1 in manual mode, the same operation is made except that the closer 11*c* is not operated.

In this embodiment, the closing-directional lever 19 of the remote control device 12 is rotated to turn on or off the handle switch 34, which assists manual operation of the slide door 1 by bringing the slide door 1 in electric mode when closing the slide door 1 in manual mode. Instead, for attaining the same results, a modification can be made wherein the handle switch 34 or an additional switch is turned on or off by the rotation of the opening-directional lever 19.

In addition, the slide door 1 can be operated in electric mode by manipulating an operation switch provided near the driver's seat. In such a structure, the remote control device 12 has to include an open actuator (not shown) which is connected to the output lever 16.

In accordance with the present invention, the opening-directional lever, the closing-directional lever, the open lever, and the output lever are mounted on the common shaft, which is unlike the conventional structure wherein two shafts are required to support these lever elements. Thus, the present invention can offer a more simplified structure of the remote control device for vehicular slide door apparatus.

The invention has thus been shown and description with reference to specific embodiments, however, it should be understood that the invention is in no way limited to the details of the illustrates structures but changes and modifications may be made without departing from the scope of the appended claims.

What is claimed is:

1. A remote control device for a vehicular slide door apparatus comprising:

a rotatable shaft;

an input lever fixedly mounted on the shaft so as to be rotated together therewith;

an opening-directional lever rotatably mounted on the shaft and positioned to be rotated by the input lever when the shaft is rotated in a first direction;

a closing-directional lever rotatably mounted on the shaft and positioned to be rotated by the input lever when the shaft is rotated in a second direction opposite the first direction;

an open lever rotatably mounted on the shaft and selectively engagable with the closing-directional lever; and an output lever rotatable mounted on the shaft and connected to the open lever.

2. A remote control device for vehicular slide door apparatus as set forth in claim 1, further comprising a locking lever including a movable coupling between the open lever and the output lever, the movable coupling movable between a locked position in which the open lever and the output lever are not coupled together by the movable coupling, and an unlocked position in which the open lever and the output lever are coupled together by the movable coupling.

3. A remote control device for vehicular slide door apparatus as set forth in claim 1, further comprising a child-proofing lever including a movable coupling between the open lever and the opening-directional lever, the movable coupling movable between a child-proofing position in which the open lever and the opening-directional lever are not coupled together by the movable coupling, and a non-child-proofing position in which the open lever and the opening-directional lever are coupled together by the movable coupling.

4. A remote control device for vehicular slide door apparatus as set forth in claim 1, further comprising an open actuator coupled to the open lever to rotate the open lever.

5. A remote control device for vehicular slide door apparatus as set forth in claim 1, further comprising an open actuator coupled to the output lever to rotate the output lever.

* * * * *